US010002561B1

(12) United States Patent
Tridico

(10) Patent No.: US 10,002,561 B1
(45) Date of Patent: Jun. 19, 2018

(54) PERCEPTUALLY CONFIGURED ARRAY OF ADDRESSABLE ELECTROMAGNETIC EMITTER ELEMENTS

(71) Applicant: Christopher Ralph Tridico, Granite Falls, NC (US)

(72) Inventor: Christopher Ralph Tridico, Granite Falls, NC (US)

( * ) Notice: Subject to any disclaimer, the term of this patent is extended or adjusted under 35 U.S.C. 154(b) by 546 days.

(21) Appl. No.: 14/083,988

(22) Filed: Nov. 19, 2013

Related U.S. Application Data

(60) Provisional application No. 61/736,125, filed on Dec. 12, 2012.

(51) Int. Cl.
*G09G 3/32* (2016.01)

(52) U.S. Cl.
CPC ..... *G09G 3/32* (2013.01)

(58) Field of Classification Search
CPC ..... G06F 3/14
See application file for complete search history.

(56) References Cited

U.S. PATENT DOCUMENTS 5,767,818 A 6/1998 Nishida
6,028,576 A * 2/2000 Hush ..... G09G 3/22 345/75.1
6,456,339 B1 9/2002 Surati et al.
7,612,736 B2 11/2009 Nakajima
8,228,261 B2 7/2012 Callegari et al.
8,427,391 B2 4/2013 Perkins et al.
2004/0021617 A1* 2/2004 Blum ..... A47L 23/22 345/1.3
2005/0093768 A1* 5/2005 Devos ..... G06F 3/1446 345/1.3
2009/0121988 A1* 5/2009 Amo ..... G09G 3/2088 345/82

(Continued)

OTHER PUBLICATIONS

Material related to NEC Corporation (Nippon Denki Kabushiki Gaisha)'s Display Wall Calibration Kit and Display Wall Calibration Software; e.g., "KT-LFD-CC Display wall calibration kit for video wall applications" color brochure 12/11 ver. 1 © 2011 NEC Display Solutions of America, Inc.

*Primary Examiner* — Amare Mengistu
*Assistant Examiner* — Shawna Stepp Jones
(74) *Attorney, Agent, or Firm* — Coats & Bennett, PLLC

(57) ABSTRACT

The present invention provides a system and related devices, systems and methods to enable the controlled and predictable emission of electromagnetic radiation from objects that previously were impossible or impractical to utilize as electromagnetic emitters or to place electromagnetic emitters on. The present invention includes addressable electromagnetic emitter "elements", a plurality of which is applied as a continuous surface coating or is otherwise integrated with one or more three dimensional objects (the "subject"). Said plurality of elements ("array of elements") is controlled by an array controller which accepts electrical input signals, generates and transmits, by means of a shared transmission medium, corresponding control signals to elements in the array. An automated configuration method and system provide configuration data utilized by the array controller to convert input signals to control signals compensating for irregular element placement, radiance and other factors unique to an application of the present invention.

13 Claims, 7 Drawing Sheets

(56) References Cited

U.S. PATENT DOCUMENTS

| | | | | |
|---|---|---|---|---|
| 2009/0322649 | A1 | 12/2009 | Hamer | |
| 2010/0321382 | A1 | 12/2010 | Amaratunga | |
| 2011/0102300 | A1 | 5/2011 | Wood | |
| 2011/0181495 | A1 | 7/2011 | Chu | |
| 2014/0055449 | A1* | 2/2014 | O'Dor | H04N 9/3147 345/419 |
| 2014/0232617 | A1* | 8/2014 | Anite | G06F 3/1446 345/1.3 |
| 2014/0313217 | A1* | 10/2014 | Walley | G09G 5/00 345/589 |
| 2015/0084837 | A1* | 3/2015 | Mese | G06F 3/1446 345/1.3 |

* cited by examiner

Fig. 1: Embodiment 1 - System Overview
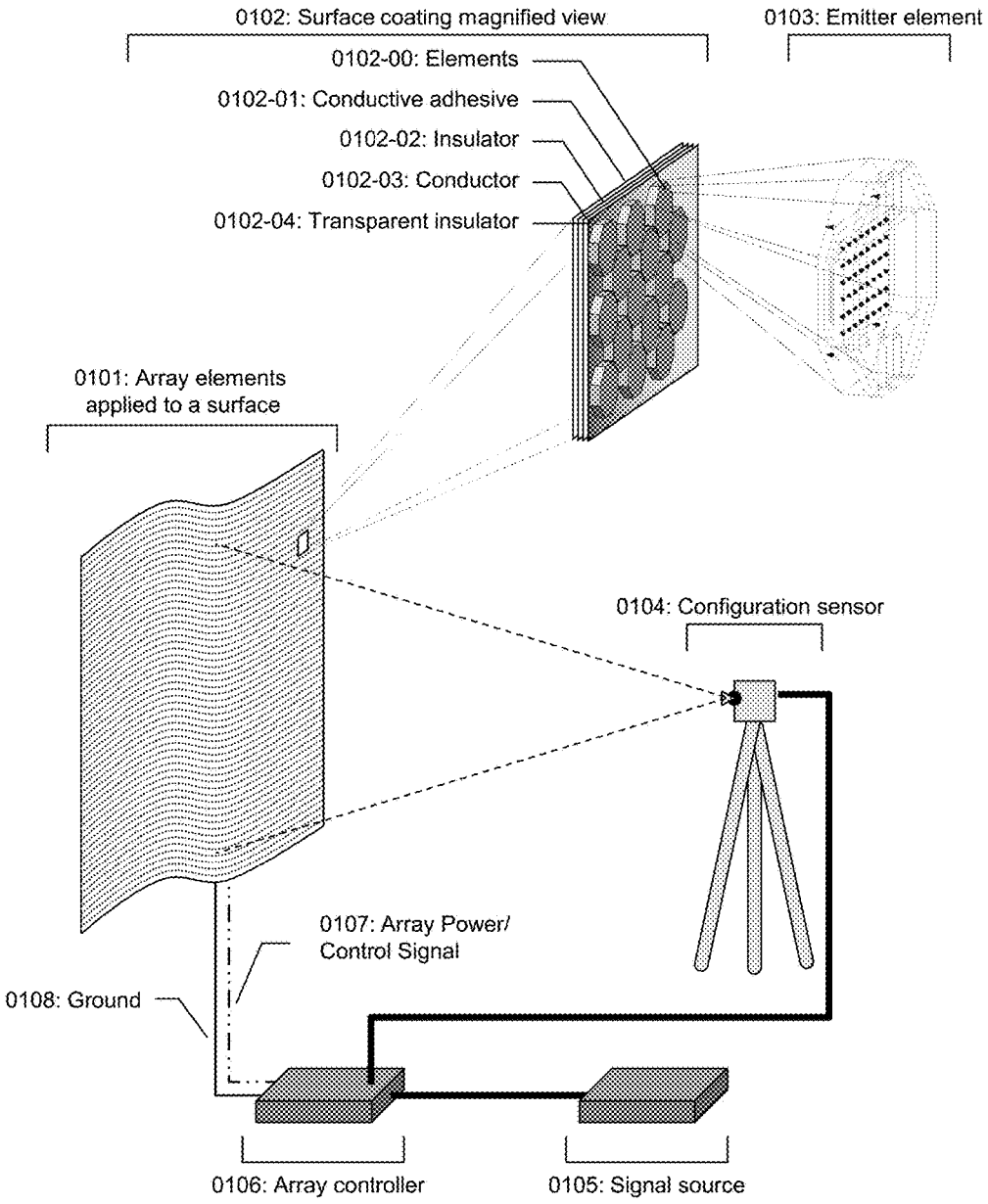

Fig. 2: Embodiment 1 – Emitter Element Overview
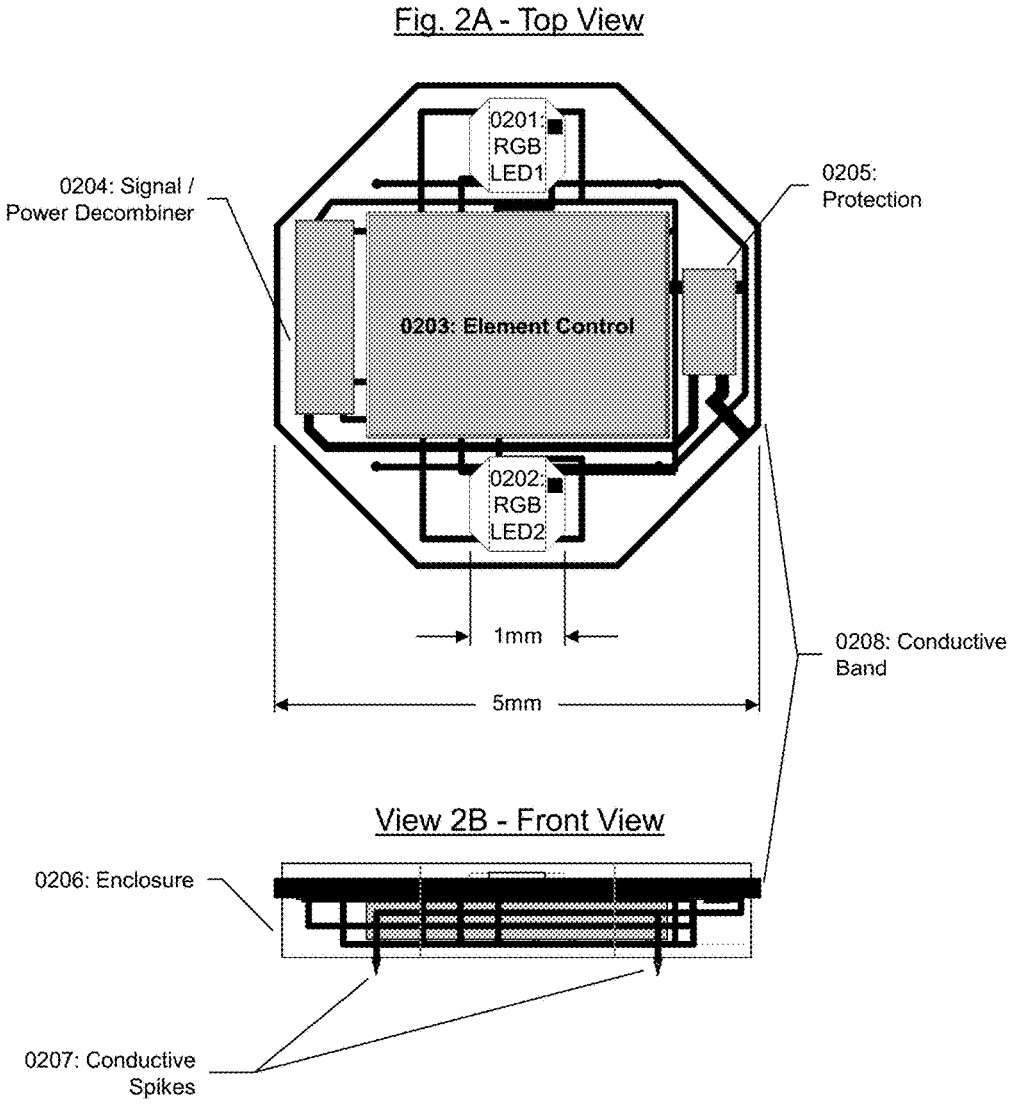

Fig. 3: Emitter Element Block Diagram
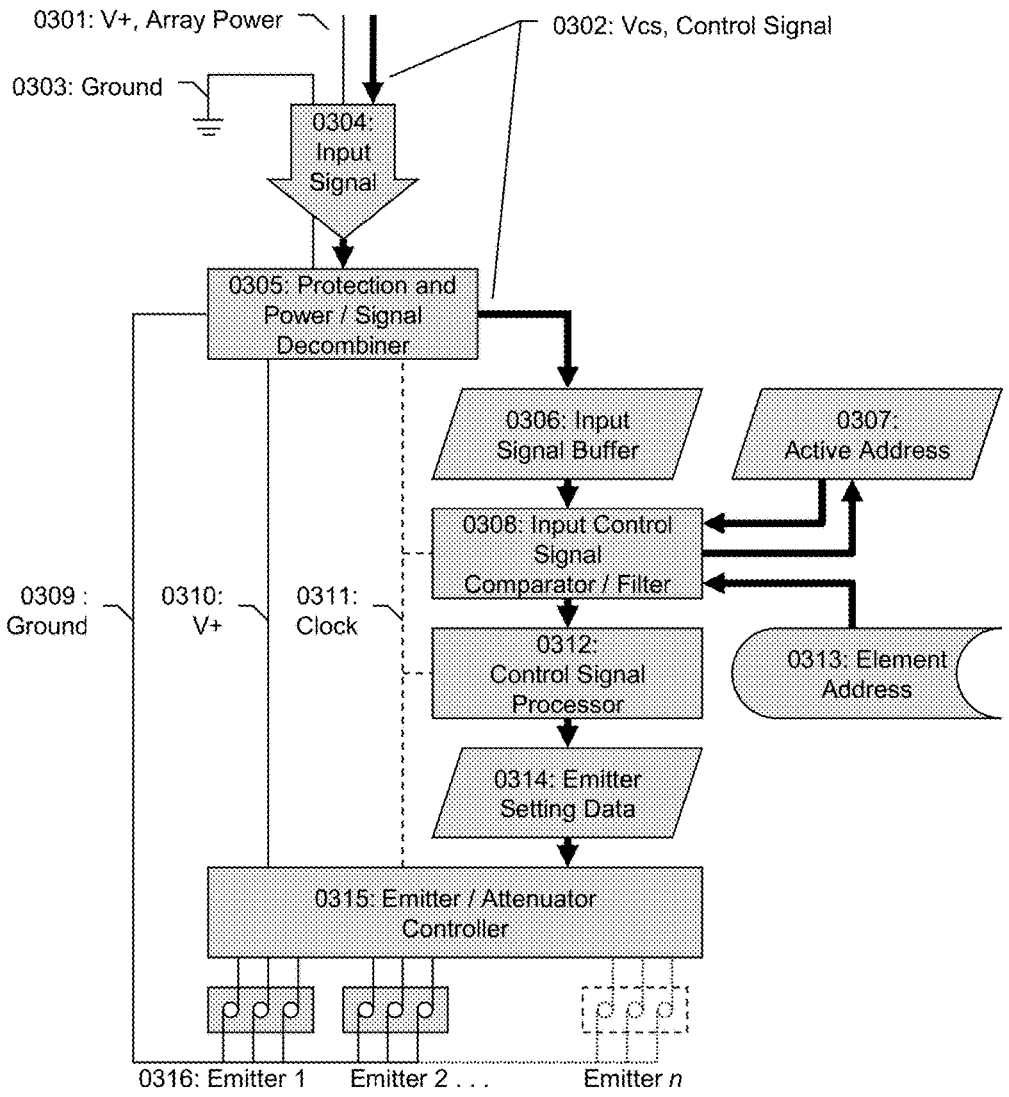

Fig. 4: Array Controller Block Diagram
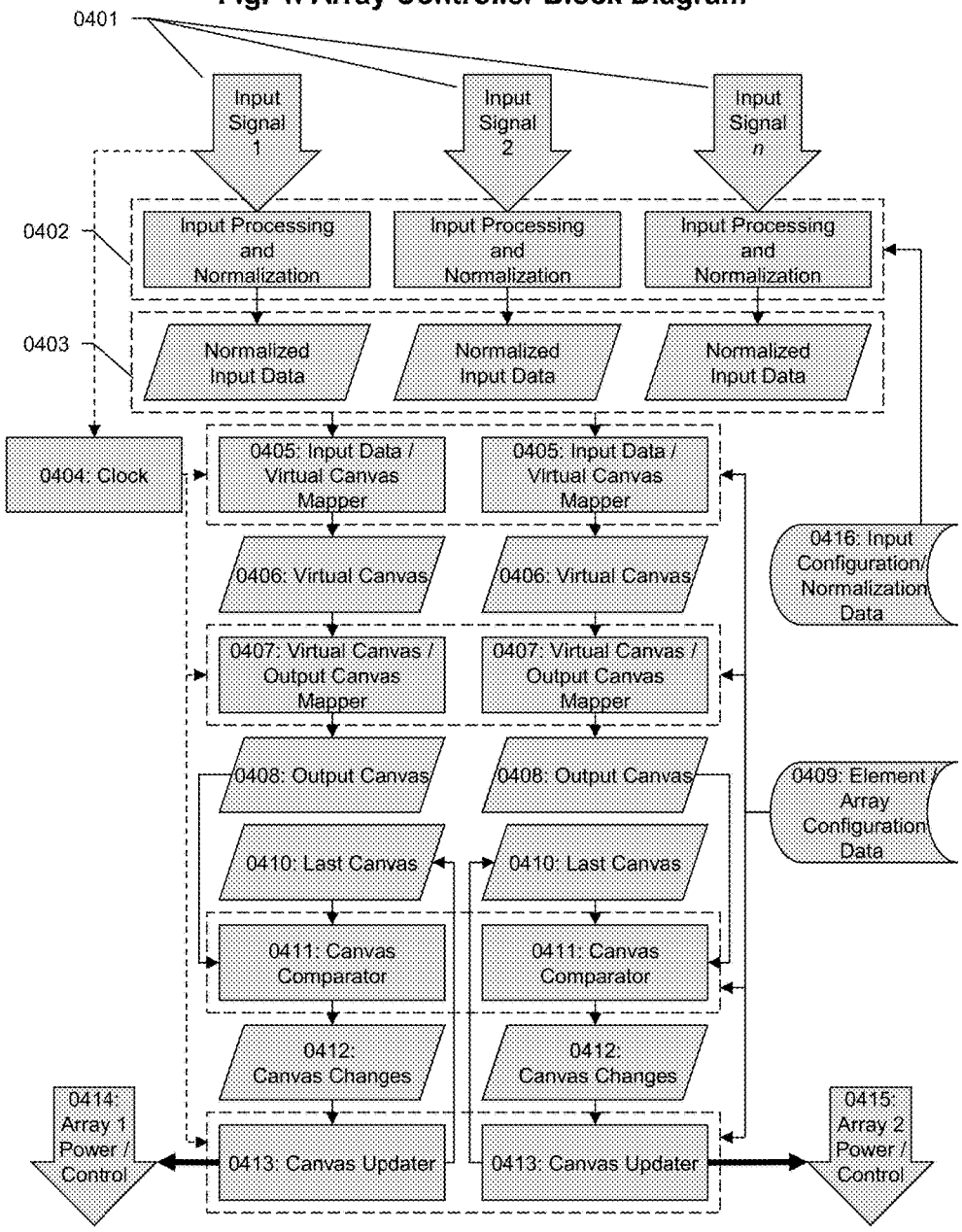

Fig. 5: General Configuration Method Flow Diagram A
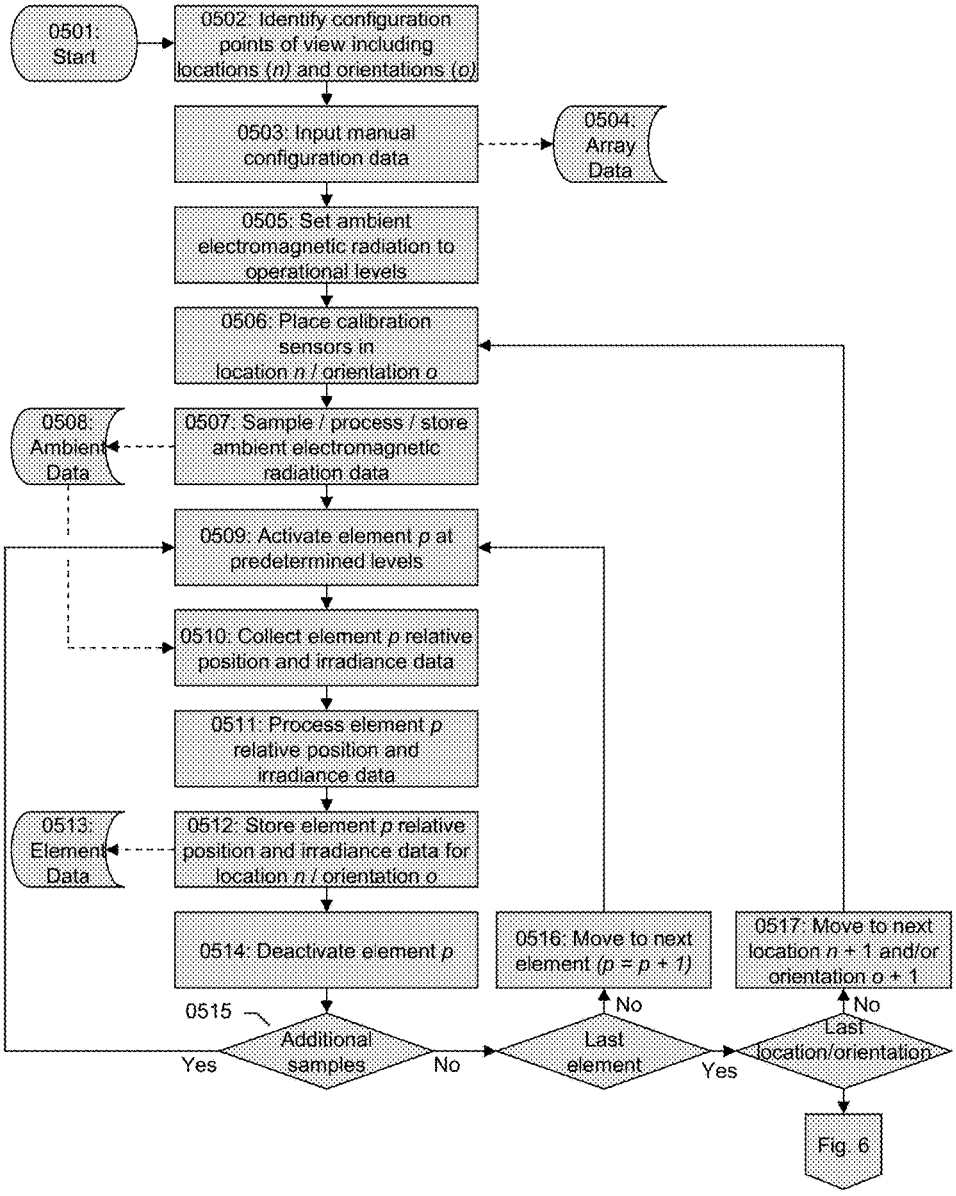

Fig. 6: General Configuration Method Flow Diagram B
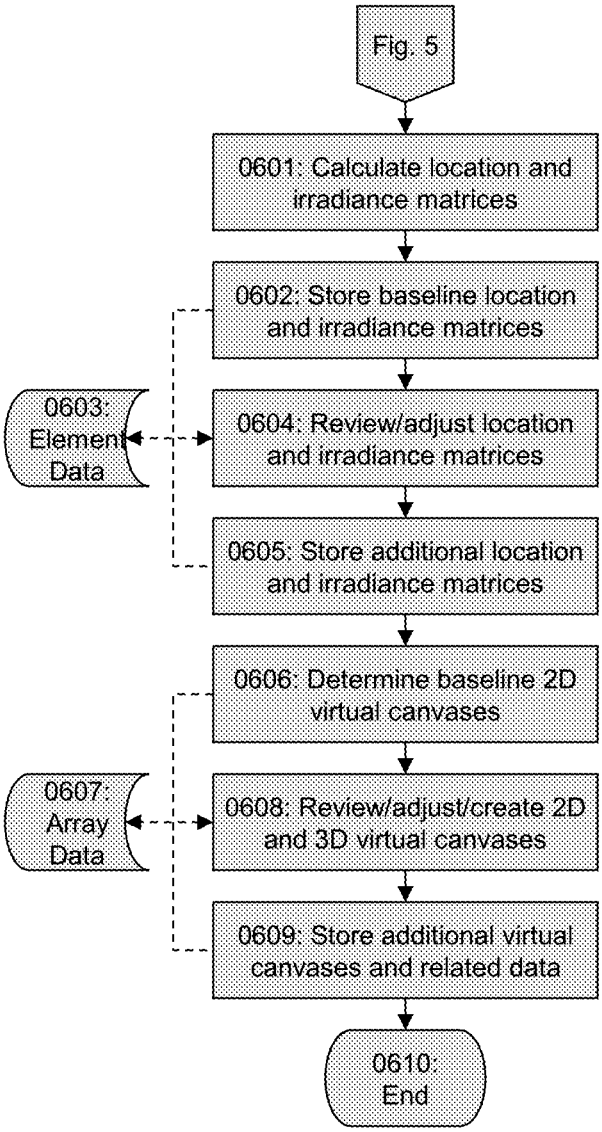

Fig. 7: Embodiment 3 – Unmanned Aerial Vehicle Application Overview
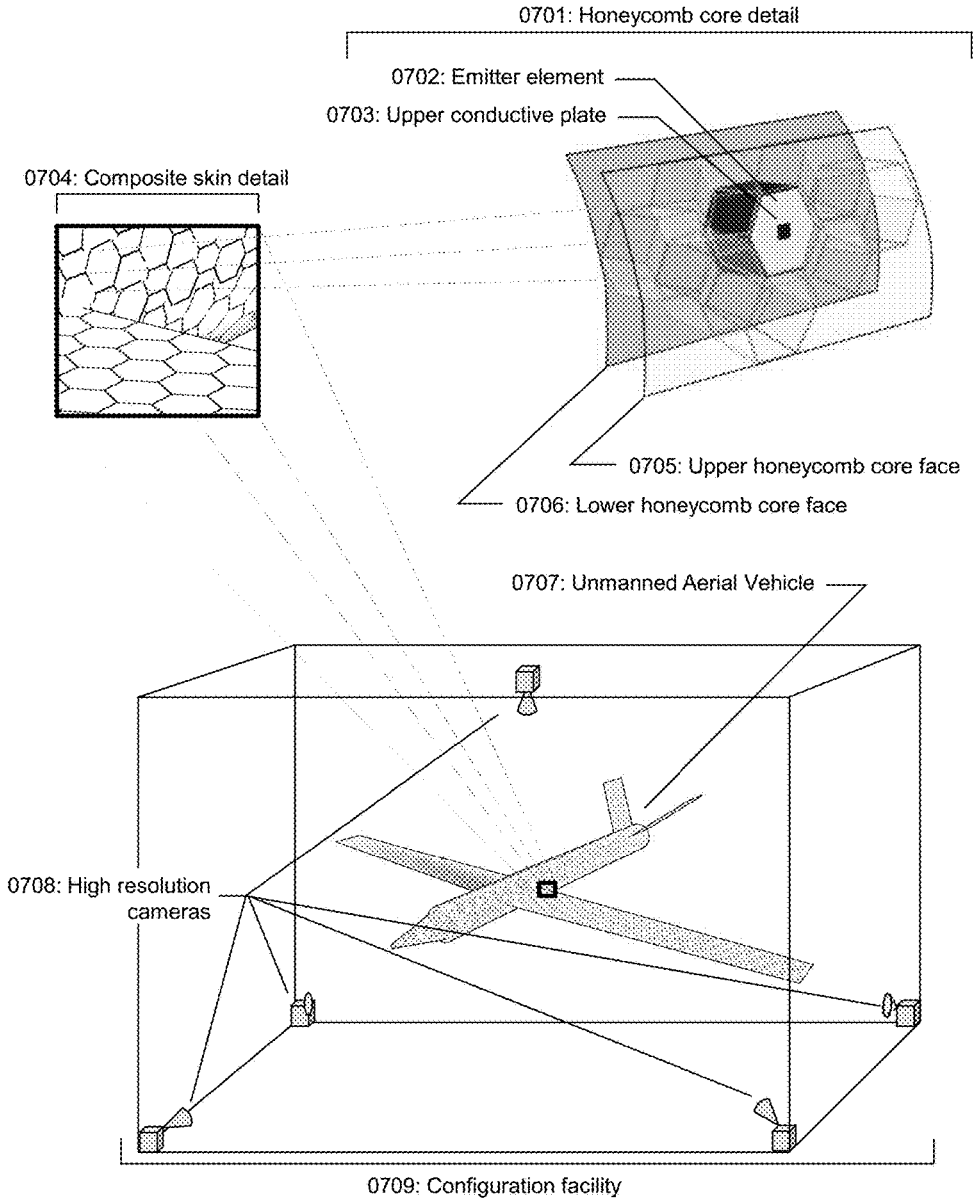

PERCEPTUALLY CONFIGURED ARRAY OF ADDRESSABLE ELECTROMAGNETIC EMITTER ELEMENTS

CROSS-REFERENCE TO RELATED APPLICATIONS

This application claims the benefit of U.S. provisional patent application No. 61/736,125, filed Dec. 12, 2012.

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

Field of the Invention

The present invention relates to the field of electronically controlled electromagnetic radiation.

Background of the Invention

It is apparent that controlled electromagnetic emissions are employed in a wide range of useful applications. Examples include electronic video displays, radio detection and ranging (RaDAR) and infrared illumination. Many of these applications require multiple electromagnetic emitters operating in a coordinated fashion, i.e., an "emitter array". Individual emitters in an emitter array may be employed to produce emissions having specific desired characteristics. Examples of these characteristics might include: emission point of origin, path, field shape, wave length, relative phase, intensity and polarization. The coordinated emitter array produces a combination of these characteristics that is required for a given application.

Prior art for the present invention includes monolithic electronic displays. Said displays are characterized by having an array of emitting elements in a fixed and uniform pattern. A cathode ray tube based display in which fixed phosphor elements are excited in a controlled fashion by one or more electron beams to display an image is an example of such a monolithic display. Monolithic displays also include flat panel displays which are suitable for semi-flush mounting on a flat surface. The control circuitry for monolithic displays is centralized and in the case of flat panel displays, a large number of dedicated connections exist between the display control circuitry and the emitters.

Prior art includes the ability to calibrate such monolithic displays through both manual adjustments and automated adjustments. Said calibration is not performed at an individual element level, but rather uniformly across the array of elements based on optimization of a region of the display or the display as a whole. As the geometry of prior art monolithic displays is intended to be fixed, said calibration does not compensate for variances in actual or perceived element spacing (pitch) or surface geometry.

Prior art includes numerous approaches to utilize a plurality of monolithic displays in a coordinated fashion. Said prior art includes the ability to mount a plurality of displays in close proximity to create a continuous array of emitters. Prior art further includes the ability to mount a plurality of displays to follow or approximate the geometry of the surface upon which they are mounted. Prior art includes the ability to coordinate the images displayed across a plurality of displays to extend an image across multiple displays.

In addition to monolithic displays, prior art of the present invention includes modular display solutions. Said modular display solutions are composed of panels, each panel having a plurality of emitters. Multiple panels are intended to be linked to a common control architecture by means of cabling or interconnectivity built into the panels themselves. Modular display solutions have many of the characteristics of a plurality of monolithic displays with greater flexibility in array geometry and dimensions. Examples of modular display solutions include display tiles utilized in display walls and perimeter advertising solutions found in arenas and sports venues.

Prior art for the present invention includes projector based systems that display images through the controlled emission of electromagnetic radiation in the visible light spectrum onto a display surface, said radiation is either reflected (in the case of front projectors) or transmitted (in the case of rear projectors) to one or more observers. Projector based systems enable elements to be displayed on a wide variety of surfaces and prior art includes methods and systems to correct for the color of the display surface. Prior art further provides solutions to correct for geometric variances in the display surface. Prior art further provides solutions to coordinate a plurality of projectors into an integrated display, potentially across multiple surfaces, and offers the ability to seamlessly integrate the output of multiple projectors through precision positioning and blending of adjacent or overlapping projected images even down to the individual element (i.e., pixel) level. Projector based systems have difficulty providing quality displays on convoluted surfaces where shadowing of the projector output is common. Projector based systems are challenging to deploy on moving vehicle exteriors. Front projector based systems may also be subject to obstruction in certain applications.

Prior art for the present invention includes ornamental lighting. Said ornamental lighting consists of individual or groups of visible light emitters applied to structures, foliage, vehicles or other objects with the intention of producing visible light displays ranging from general illumination to coordinated displays. Prior art for said ornamental lighting includes control solutions that enable control of emitters using dedicated cabling or addressable emitters with control signals sent over shared media. Said ornamental lighting is not easily integrated into subject objects and requires cabling and attachment hardware or the subject objects must be modified or purpose built to integrate said ornamental lighting. Prior art does not include an automated means to configure said ornamental lighting to provide predictable irradiance at one or more points of observation.

Prior art is not limited to electromagnetic emissions in the visible light portion of the electromagnetic spectrum. An example of prior art in this field that produces EM emissions outside of visible light spectrum is a phased array radar in which coordinated signals are applied to a plurality of radar antenna, i.e., transmit/receive elements, in order to control the radiation pattern of the overall array. Said transmit/receive elements, hereafter referred to as T/R elements, often include dedicated electronics, e.g. local oscillators, high power amplifiers and low noise amplifiers. An individual knowledgeable in the field can reasonably expect said T/R elements to evolve to include additional dedicated electronics such as element specific analog to digital converters. Prior art T/R elements are mounted to a common dedicated structure in a pre-defined configuration. Prior art T/R elements are tied to centralized controllers, e.g., digital beam formers and digital signal processor through dedicated cabling.

Prior art does not provide a general solution that allows an individual or other entity without specialized capabilities in applicable technology to construct an array of emitters on or within an object of their choosing and expect it to provide predictable, quality irradiance.

Technical Problem

Prior art related to the present invention possess a number of characteristics that limit application of arrays of EM emitters on subjects where they would otherwise have useful application. These characteristics increase cost and effort and in some cases, provide poor results or make arrays of EM emitters impractical to apply to these subjects. Technical problems with prior art addressed by the invention include the following:

Undesirable impact on the fluid dynamic properties of the subject—Prior art is not an integral part of the surface and its addition may adversely impact fluid dynamic properties, e.g., cross sectional area, coefficient of drag, center of pressure and fluid flow paths around the subject. While these impacts may be engineered around, doing so is often costly and is particularly challenging in the case of high performance vehicles.

Undesirable impact on the mechanical properties of the subject—Frames, spars, offsets and other mounting apparatus utilized in prior art have significant impacts on the mechanical properties of the subject beyond the increase in mass dictated by the operational components of the emitter array. These impacts to mechanical properties might include alteration of center of gravity, increase in polar moment of inertia, decrease in natural frequency and increase in moments due to the lever arms of the mounting apparatus. These impacts may require significant alteration to the engineering of the subject, particularly in the case of high performance vehicles.

Undesirable impact on aesthetics and constraints on the design of the subject—Panels or sub-assemblies with flat surfaces and fixed dimensions, projectors, cabling and visible mounting hardware are present singularly or in combination in all forms of prior art. These characteristics create constraints often dictating that designs incorporate surfaces that are flat or symmetrically curved to achieve optimum performance from the array of emitters. A second shortcoming in prior art with respect to enabling flexible design is that irregular array borders are difficult to achieve with the fixed-size sub-assemblies of prior art. Partially concealing sub-assemblies, leaving areas uncovered by emitters or engineering custom sub-assemblies are often required to provide design flexibility. Sub-assembly dimensions often limit design choices. An additional example of the aesthetic shortcomings of prior art is that additional materials and design effort must be expended if it is desired that an array of emitters is to appear inconspicuous and well integrated with the subject.

Undesirable impact on the surface geometry of subjects striving for low observability—The geometry of prior art emitter arrays, including the use of flat surfaces positioned to optimize array performance, edge transitions and abrupt features such as array cowling or mounting apparatus, complicates purpose shaping of the subject. This is particularly problematic in the likely case where the purpose of the emitter array is to provide destructive interference or to otherwise reduce the subject's observability as in the case of low observable vehicles.

Connectivity requirements—Applications of prior art utilizing a plurality of stand alone or modular emitter panels or sub-assemblies require multiple connections for both power and control. Connectivity requirements increase in complexity as the application scale increases, i.e., the number of emitters increase. In some examples of prior art, extensive electrical cabling is required and this cabling must be concealed, secured and protected. Examples of prior art exist that address this through the use of panels or sub-assemblies which incorporate facilities for connecting additional panels through a pass-through or serial approach sometimes referred to as a "daisy-chain". The direct connection required for this pass-through approach limits sub-assembly placement flexibility or requires the use of cabling between sub-assemblies.

Difficulty in applying emitter arrays in retrofit applications—Shortcomings in prior art are increasingly problematic when applying an array of electromagnetic emitters to a pre-existing subject for which emitter array application was not originally a consideration. Array attachment, connectivity, aesthetic impact and impact on subject performance are more difficult to address on a pre-existing subject.

Limited ability to support irregular and three dimensional emitter arrays—The calibration systems and methods found in prior art do not support applications where the actual number of emitters and their relative positions are unknown. The calibration and control systems in prior art do not support linking emitters on a real-world three dimensional object with a virtual three dimensional representation of that object. For example, in prior art a three dimensional model of an aircraft is mapped to a two dimensional array of emitters in a projector to be displayed on a screen in a simulator. Prior art does not support mapping the same model to an actual aircraft to control the aircraft's surface coloring and livery. Prior art does not facilitate providing greater pixel density at areas of higher visual acuity or allow compensation for variances in apparent emitter spacing as perceived from one or more points of observation. For an example of this, consider an observer viewing a large flat panel display with a regular pixel pitch at a distance that allows the display to fully encompass the observer's field of vision. Pixels at the periphery of the observer's field of vision are viewed at an acute angle and each pixel is perceived in a smaller visual angle for the observer than those pixels at the center of the observer's field of view, these later pixels being viewed from an angle normal to the plane of the display. Thus, the pixel density as presented to the observer is lowest at the center of the observer's field of vision. This is despite the fact that the greatest ability to resolve detail is located at the center of the observer's field of vision.

BRIEF SUMMARY OF THE INVENTION

The present invention is a system, along with related devices, systems and methods, to provide controlled electromagnetic ("EM") radiation from one or more objects, said objects not being otherwise capable of the controlled emission of EM radiation. Said objects, collectively referred to as the "subject" may have complex geometry and discontinuous surfaces. The location, orientation and geometry of said objects may vary with time.

The present invention employs a plurality of emitter elements ("elements") that are applied to the subject as a continuous surface coating or are otherwise integrated with the subject. Said elements may be placed with varied regularity and orientation and individual elements may vary in their construction and function; e.g., they may employ various filters, emitter types, emitter quantities, connection types, et al. Said plurality of elements is collectively termed an "array of elements". Said array of elements is controlled in a manner which provides predictable irradiance at one or more points of observation. The emitted radiation may be from any range or from multiple ranges in the EM spectrum. Said EM radiation is generated actively by the elements or passively through the controlled attenuation or reflection of radiation from other sources by said elements.

The array of elements is controlled by an array controller. Said array controller accepts one or more input signals from signal sources such as computers, video players, electronic controllers, or other electronic devices. Said array controller then converts these input signals into array control signals. Said control signals are sent by the array controller, along with electrical power, to the array of elements over a shared transmission medium.

The present invention further incorporates systems, devices and methods to enable the configuration and calibration of electromagnetic emissions from said arrays of emitters to provide predictable irradiance at one or more points of observation located in three dimensional space around the subject. The configuration information utilized by the controller to convert inputs to the required control signals is generated in an automated configuration method. Said method includes the activation of individual elements in the array, monitoring the resulting irradiance using sensors located at the desired points of observation and calculating configuration data that will adjust for each element's location and emission characteristics.

The collective result of the present invention is that objects that previously were impossible or impractical to utilize as EM emitters, or on which to place EM emitters, may now be used to provide EM emissions in a controlled and predictable manner.

The present invention encompasses the following:

1. A device which is an emitter element that may be incorporated into or applied to objects as a partial or complete surface coating with flexibility in location, orientation and density as required by the application. A plurality of said emitter elements are used to construct an array of emitter elements in which individual elements are controlled through control signals addressed to individual elements in said array.
2. Simplified emitter element connectivity through a shared transmission medium with as few as two conductors that may be incorporated into the structure of the subject's surface or coatings applied thereon.
3. A device which is an array controller to introduce power and control signals through a shared transmission medium to an array of addressable EM emitter elements.
4. A system and a method to configure the array of electromagnetic emitters to provide predictable irradiance at one or more points of observation.

BRIEF DESCRIPTION OF THE SEVERAL VIEWS OF THE DRAWING

FIG. 1: Embodiment 1—System Overview
FIG. 2: Embodiment 1—Emitter Element Overview
FIG. 3: Emitter Element Block Diagram
FIG. 4: Array Controller Block Diagram
FIG. 5: General Configuration Method Flow Diagram A
FIG. 6: General Configuration Method Flow Diagram B
FIG. 7: Embodiment 3—Unmanned Aerial Vehicle Application Overview

DETAILED DESCRIPTION OF THE INVENTION

Advantageous Effects of Invention

The present invention will allow the surfaces of buildings, vehicles and other objects to be partially or fully coated with arrays of EM emitter elements that conform to the coated surfaces. Said arrays will provide predictable irradiance at one or more points of observation enabling the display of images, videos or predictable irradiance by non-visible EM emissions. The present invention provides the following advantages when compared with prior art:

Emitter elements are incorporated on the surface of or into the subject thus minimizing the impact on mechanical and fluid dynamic properties of the subject. Elements incorporated into a composite surface may be non-load bearing or may carry a specific load for which they are designed. As a result, said elements may have no negative impact on the mechanical properties of the subject and will remain out of areas of fluid flow. Elements applied as a surface coating may have a minimal and uniform impact on surface dimensions and be closely bonded with the surface. Said surface coatings may serve to strengthen the surface structures or perform the same function as a non-emissive surface coating with similar mechanical properties. As a result, said surface coating applications of elements may have negligible or even beneficial impacts on the mechanical and fluid dynamic properties of the subject.

Aesthetics and design flexibility—The ability of the array of emitter elements to conform to the geometry of a subject is limited by the size of individual elements. While in one current embodiment of the present invention this is limited to a flat circular dimension of approximately 1 mm in thickness by 5 mm in diameter by practical state of the art considerations, mass production and continuing advancements in manufacturing and miniaturization will allow increased geometric conformity. It is reasonable to assume that the elements claimed in the present invention could be utilized as a component in a liquid film-forming surface coating such as paint. Furthermore, the ability to minimize, hide or obviate cabling, frames and other attachment or connectivity hardware combined with the unobtrusive form factor of the emitters provide flexibility in the aesthetics of an array of EM emitter elements of the present invention even when said array is not in use.

Array maintenance—In cases of minor degradation in element emitter performance, element failure, or sub-optimal element placement, the configuration system and method of the present invention may compensate. In cases of significant element failure or desire to upgrade an array to elements with additional capabilities, a surface mounted element array or portions thereof may be replaced in manner and with a complexity level similar to that of replacing ceramic tile of similar size. Array elements formed into a surface may require replacement of a portion of the surface or a complete surface panel. In cases of full or partial array element replacement, the configuration system and method of the present invention will be utilized to re-configure following the replacement of components.

Heterogeneous emitters—The modular nature and perceptual configuration of the present invention allow an application of the invention to be constructed of emitter elements with different characteristics and positioned with varied regularity and orientation. For example, a single application of the present invention could include regions of higher emitter density, elements oriented to provide irradiance to specific points of observation, elements with polarized emission and elements specialized to emit certain portions of the EM spectrum.

Application across non-continuous surfaces—Elements in an array may be located on surfaces that are not directly connected and are in fact located significant distances from one another and still produce predictable and seamless emissions as perceived from one or more points of observation. The configuration method for the present invention provides a means for elements to be treated as being adjacent if they are perceived as being adjacent from a point of observation even if there are intervening elements or a discontinuity of surfaces that might be visible from another point of observation. The configuration method further compensates for differences in irradiance resulting from variations in distance, output or orientation of elements.

Reduction in design, engineering and configuration time—The present invention allows the same systems, devices and methods to be incorporated into subjects of varied sizes and shapes reducing the design and engineering effort required in applying embodiments with similar functional requirements to varied subjects. The present invention automates configuration of electromagnetic emitters reducing effort associated with optimizing placement and performing manual configuration. The present invention simplifies connectivity through the use of a minimal number of connections that can be applied as uniform coatings on the surface of a subject.

Retrofit facilitation—The ability to coat existing geometrically complex surfaces with an array of elements that has a minimal impact on mechanical and fluid dynamic properties, connect this array electrically with a minimum number of non-invasive connections and then utilize automated means to configure the array for varied applications makes the present invention ideal for consideration on retrofit applications. This is the case even when a subject was not originally designed with an array of electromagnetic emitters in mind.

Multi-perspective 2D and 3D virtual canvases—The configuration system, devices and method of the present invention enable the creation of two dimensional virtual canvases. Said two dimensional canvases approximate the irradiance of a flat plane of regularly spaced EM emitters despite being non-planar and having irregular emitter spacing. Said canvases allow prior art video signals to be connected to the present invention's array controller and to control the elements in the array presenting a display approximating that of a traditional monolithic display. An example of this in one embodiment of the current invention would include connecting five video signals to the controller for an array of elements coating the surface of an automobile. The virtual two dimensional canvases could include one each for the front, top, rear and each of the sides of the automobile. Each of the five virtual canvases would display a two dimensional video. The present invention enables the same array to be configured as a three dimensional virtual canvas conforming to said automobile's surface. This allows direct mapping of the elements on the vehicle to a virtual three dimensional model of said vehicle contained in a computer or other electronic device. Color, texture or other graphic data in the virtual model would then control the emissions from the elements on the actual vehicle to reflect the virtual model. These emissions would appear as graphics incorporated onto the surface of the vehicle. The present invention allows multiple two and three dimensional canvases to be configured for the same application and to alternate among said virtual canvases as desired.

DESCRIPTION OF EMBODIMENTS

Embodiment 1—Video Images Displayed on an Object with a Convoluted Surface

A first embodiment of the present invention includes the following devices: visible light emitter elements (FIG. 1, 0103), a plurality of which is intended to be applied to the surface of convoluted objects; an array controller (0106) capable of converting one or more standard video input signals to a control and power signal for an array of EM emitter elements delivered over a single pair of conductors (0107, 0108); and a 1080p video camera (0104) for providing configuration input to said array controller.

A simple application of this embodiment, coating of the surface of a masonry wall having an irregular curved surface, is presented in FIG. 1 to facilitate explanation (0101); however, this first embodiment of the present invention is expected to be applied to a wide range of subjects including, but not limited to: partial or complete building interior and exterior surfaces, vehicle surfaces, furniture, equipment, tools, containers and other objects.

An emitter element of the first embodiment of the present invention is presented in FIG. 2. Each instance of said element is composed of two tri-color visible spectrum LEDs (0201, 0202), a control circuit (0203), a protection circuit (0205) for limiting potentially damaging electrical signals and a signal/power decombiner circuit (0204) for separating the array's electrical power signal from said array's high frequency control signal. Said components are contained in a flat polycarbonate enclosure (0206) roughly 1 mm thick and 5 mm in width. Said enclosure contains three dimensional conductive traces for required electrical connections with the only conductive material on the exterior of the enclosure being four conductive spikes (0207) on the bottom flat surface and a conductive band (0208) around the octagonal perimeter of the enclosure. Said exposed conductive material is employed as the electrical connections between each array element and the shared control/power medium of the array.

In this embodiment of the present invention, the emitter element control circuit (0203) is a single ultra fine ball grid array ("UFBGA") integrated circuit accepting both power and control signals, selectively processing said signals and controlling the output to connected devices through pulse width modulation. Said control circuit is given a default 24-bit address through mechanically disabling selective connections between the array power and the UFBGA. Said default address may be superseded through use of set/change address commands delivered through the control signal and stored in non-volatile memory. In this embodiment of the present invention, six of the available control circuit outputs are utilized to control power to the emitter elements through connection to the RGB terminals on two separate ultra small scale tri-color LEDs.

FIG. 3: "Emitter Element Block Diagram" provides a general function block diagram of an emitter element. A combined input signal (0304) including power (0301), a control signal (0302) and ground (0303) is received by each element from the array's shared electrical media. Said combined signal may leverage any specialized or standard technology for transmitting high speed serial data and power such as high frequency low-voltage differential signaling into which low voltage DC power is injected. In the first embodiment of the present invention a purpose built and specialized approach is used to deliver a combined power and control signal. Said combined signal is a square wave alternating between positive and negative 3 volts of electrical potential relative to ground. In this embodiment each half period represents a single bit with a 3 volt amplitude representing a binary 0. A binary 1 is represented by an approximately 1 volt deviation from the 3 volt amplitude. Amplitudes of positive 2, positive 4, negative 2 and negative 4 volts are utilized for binary 1s and are used alternately to maintain an average potential of 3 volts when the combined signal is passed through a full wave rectifier.

In the emitter element block diagram (FIG. 3), unintentional and potentially damaging input signal components are eliminated and power and control signal components separated by a protection and power/signal decombiner (0305). Said decombiner outputs a control signal (0302), a ground (0309), stable direct current power (0310) and a clock signal (0311) synchronized to the input signal frequency. Ground and power are provided to all devices in the element. The control signal (0302) is buffered (0306) and the address contained in the control signal (0307) compared with the address of the current element (0313) to determine if the control signal is to be acted on by the current element. In the event that the control signal is to be acted on by the current element, the control signal content is acted on by a control signal processor (0312). Said processor extracts and processes emitter setting information from the control signal and stores the appropriate emitter setting data (0314). A controller (0315) regulates power to each of the devices contained in the current element based on the values contained in the emitter setting data (0314). In the first embodiment of the present invention, pulse width modulation is used to control power delivered to emitter elements (0316); however, this function may be performed by other technologies.

The functions in the emitter element block diagram (FIG. 3) may be performed by a single device or distributed across multiple devices, and these devices may be standard devices or may be developed specifically for a particular application. In the case of the first embodiment of the present invention, protection and power decombiner functions are performed by separate dedicated devices, emitter functions are provided by standard ultra-small scale tri-color LEDs and the balance of the functions and capabilities are provided by a single purpose built device.

In an application of the first embodiment of the present invention shown in FIG. 1, a plurality of array elements (0102-00) is applied to any non-conductive surface utilizing a thin, continuous layer of conductive adhesive (0102-01). In addition to the array elements, an electrical terminal is affixed to provide electrical connection to the conductive adhesive. After the conductive adhesive cures, a non-conductive insulating layer (0102-02) is applied and worked into the spaces between array elements. After said insulating layer cures, a second conductive layer (0102-03) is applied and worked into the spaces between the elements. A second electrical terminal is affixed to provide electrical connectivity to the second conductive layer. After the second conductive layer cures, a translucent electrically non-conductive layer (0102-04) is applied to complete the surface coating.

In this embodiment of the present invention, an array controller (0106) is affixed to the electrical terminals attached to the array. Said array controller provides both power and a high frequency control signal to the array through ground (0108) and shared array power/control signal (0107) cables. Said signals are separated by the signal/power decombiners located in each array element.

FIG. 4: "Array Controller Block Diagram" provides a general function block diagram of the functions performed by an array controller of the present invention. Said array controller receives standardized or specialized input signals (0401) from any number of devices. Said input signals are processed and converted into a common or normalized format (0402) using configuration and normalization data (0416) entered manually or generated automatically through a configuration method and sensing of the input signal characteristics. This normalized input data is stored in the array controller (0403). Said normalized input data is then mapped using one or more mapping processes (0405) to virtual canvases consisting of one or more local information stores (0406) that represent arrays of electromagnetic emitter elements as perceived from various points of view. Said virtual canvases are then mapped (0407) to corresponding output canvases (0408) representing the required settings on the arrays' emitter elements. Said mapping is accomplished using element and array configuration data (0409) that compensate for the perceived location and irradiance of the elements. The required settings in the output canvases are compared (0411) with the values that have been most recently requested from the array of elements (0410) and any required changes stored (0412). One or more canvas updaters (0413) monitor the required changes (0412), send the appropriate commands to the array(s) (0414 and 0415), adjust the representations of the most recently requested array values (0410) and eliminate the processed data from the required change data (0412). All functions are synchronized through a common clock (0404), said clock being synchronized with one or more of the input signals if appropriate, e.g., if the input signals are video signals or other signals where synchronization of timing across devices is required. A given instance of an array controller may have facilities to receive and process any number of input signals (0401) of various types and control any number of arrays of addressable electromagnetic emitter elements (0414/0415).

In the first embodiment of the present invention, a single repositionable high resolution video camera (FIG. 1, 0104) with an evenly spaced homogeneous array of photo sites is employed as the multi-dimensional sensor used to configure the array. Said camera is connected to the array controller (0106) and is utilized to perform automated configuration of the array. Said configuration may also be facilitated by a terminal, computer or other electronic devices that serve as a user interface or to otherwise facilitate configuration. Said configuration method in this embodiment of the present invention includes the following specific example of the general method outlined in FIG. 5 beginning at start (0501) and continuing on FIG. 6.

1. Identify one or more configuration points of view (0502). A configuration point of view is a combination of a position (n) and orientation (o) in three dimensional space relative to the subject from which the array of EM emitters will be observed.
2. Provide manual configuration data that is available prior to automated configuration (0503). This may be accomplished via facilities provided on the array controller or through another electronic device which is interfaced with the array controller. Examples of said manual data include, but are not limited to: number of elements, array starting address, irradiance sensitivity, samples per element, sample emission levels, desired sample emission spectra, number of ambient samples and quantity of configuration points of view. Said manual data is stored in the array controller (0504).

3. Set the ambient light conditions surrounding the object coated with the array of emitter elements to the same level or an approximation thereof as is expected when the array is in use (0505).
4. Place the configuration sensors, in this embodiment a high resolution video camera, in the first configuration point of view (0506).
5. The ambient light level as observed by each photo site on the video camera is then stored (0507) in a non-volatile manner in the array controller as a baseline (0508).
6. The array controller sends a signal to the first element in the array to activate at a configured output level (0509).
7. The incident light level as observed by each photo site on the video camera is then compared with the ambient light level stored earlier and the increase, if any, calculated (0510).
8. Processing is performed on position and irradiance data (0511), in the first embodiment of the present invention this includes the following:

The perceived center of the increased light is calculated relative to the photo site grid of the video camera giving a relative coordinate (X, Y). This is accomplished by applying a two dimensional centroidal calculation to the increase in incident light level at each pixel of incidence:

$$X = \frac{\sum_{n=1}^{p} x_n M_n}{\sum_{n=1}^{p} M_n} \quad Y = \frac{\sum_{n=1}^{p} y_n M_n}{\sum_{n=1}^{p} M_n}$$

where:

p=the total number of incident photo sites $x_n$=the relative x coordinate of incident photo site n $y_n$=the relative y coordinate of incident photo site n $M_n$=the relative magnitude of the increase in light incident on photo site n The increased radiant flux (total increased light) incident on photo sites a configurable distance from the perceived center is calculated and used to calculate total increased irradiance.

Anomalies are identified, such as any photo site experiencing higher irradiance increase than sites closer to the perceived center, photo sites experiencing a decrease in irradiance relative to ambient levels and asymmetrical increases in irradiance.
9. The location of the perceived center, irradiance and indicators of anomalies are stored (0512) in a non-volatile manner as element data (0513) in the array controller along with the element address and identifiers indicating sample number, emission levels and configuration point of view of the video camera.
10. The array controller then sends a signal to the first element of the array controller to cease emission (0514).
11. The process is repeated at varying emission levels (0515) and for each element in the array (0516) without adjusting the location or orientation of the video camera.
12. The process is then repeated in full at the other identified configuration points of view (0517).
13. Following collection of configuration data for each configuration point of view, collected and calculated data are aggregated and indexed by relative position (0601). This baseline element data (0603) is stored (0602) on the array controller and made available for manual adjustment to address anomalies or make other changes (0604). Updated element data is stored as additional data (0605) so as to retain baseline element data.
14. Each configuration point of view represents a separate two dimensional virtual display to which video images may be directed (0606). Each of these virtual displays is referred to as a "virtual canvas". Baseline virtual canvases may be reviewed and adjusted manually (0608) and the information defining the new or modified canvases stored on the array controller (0607). Such adjustments might include:

Linking of multiple virtual canvases into a single canvas—Configuration points of view that resulted in some or all of the same elements being perceived may be optionally linked to form a single continuous virtual canvas. Virtual canvases that do not share elements may also be linked to form a single continuous canvas;

Splitting virtual canvases—A single virtual canvas may be split into two or more virtual canvases;

Element arbitration—In the case where individual elements or groups of elements are perceived from more than one point of view and the points of view are kept as separate canvases, an arbitration method is assigned to the contentious elements. The arbitration method may include selecting one canvas as being the primary for the contentious elements or allowing some combination of the relevant canvases to activate the contentious elements. A user will manually set a proportioning level for each relevant canvas indicating the percent of that canvas's output for the elements in question that will be sent to the contentious element(s);

Traditional display mapping—Virtual canvases differ from traditional monolithic displays in that their boundaries may be irregular and as such each virtual canvas intended to display a traditional source signal will be configured with orientation, scale and position information for traditional source signals. This may result in partial letter boxing, clipping, or stretching of the image. Ambient or other extrapolated information may be calculated from the traditional display signal to fill in otherwise blank pixels on the virtual canvas;

Three dimensional mapping—Virtual canvases may be enhanced with additional dimensional data allowing the canvas to accurately represent the three dimensional surface on which it is presented. This additional dimensional information may be utilized through a modified, specialized, or a to-be-developed standardized interface to allow direct control of the elements on the surface through one or more three dimensional virtual canvases representing EM emitter elements on the actual surface of the subject.

The relative X, Y and optional Z coordinates of each element on each canvas are compared to determine the maximum perceived relative distance between the elements. This maximum relative distance is used to calculate the default resolution for each canvas. Users may manually override or adjust said virtual canvas resolution. This virtual canvas resolution determines the effective display resolution of the canvas and creates a new set of virtual canvas coordinates that indicate a position on the virtual canvas in question.

Each element is assigned to a coordinate on one or more virtual canvases. A given element may be assigned to different coordinates depending on the portion of the EM spectrum due to the difference in position of the various emitters on the element. Multiple elements may be assigned to a single virtual canvas coordinate.

15. Correction factors are calculated to normalize perceived output across all coordinates for all canvases.
16. Virtual canvas information and related configuration information are stored in a non-volatile manner for access by the array controller (0609).
17. The configuration process is complete (0610), but may be revisited in part or in its entirety as required.

In this exemplary application of the first embodiment of the present invention, the collective configuration data is utilized by the array controller to report available display information, e.g., resolution and refresh rate, for a single combined virtual canvas to a video source input signal that is connected by an industry standard connection, e.g., a video source connected with an HDMI compliant connection (0105). Said video source provides data to the array controller which is then converted by said controller utilizing the previously developed configuration data and output to a single array of EM emitter elements as a high frequency signal. Said signal is received and acted upon by the individual elements to provide a cohesive video display of the source data, this despite the irregular shape of the displaying surface.

Embodiment 2—Electromagnetic Guided Munitions Countermeasures on a Vehicle

A second exemplary embodiment of the present invention is intended to retrofit multiple high-power emitters to a vehicle in order to alter the vehicle's EM signature and enhance jamming signals for a wide spectrum guided munitions countermeasure suite such as that applied to aircraft to reduce the threat from guided missiles. This second embodiment includes the following devices: infrared/ultraviolet emitter elements, a plurality of which is intended to be applied to the surface of convoluted objects, an array controller capable of converting control signals from the electronic control unit ("ECU") of a counter-measure suite to a control and power signal for an array of EM emitter elements, said signals being delivered over a single pair of conductors, and a multi-spectral camera for providing configuration input to said array controller.

The emitter elements of this embodiment are each composed of multiple high power solid state infrared and ultraviolet lasers, a control circuit, a protection circuit for limiting potentially damaging electrical signals and a signal/power decombiner circuit for separating the array's electrical power signal from the array's high frequency control signal. Said components are housed in a dome shaped enclosure with a transparent lens for the emission of radiation. A plurality of said enclosures is intended to be electrically grounded to the subject vehicle's chassis and connected to an array controller via a single shared control/power medium.

In this embodiment of the present invention, the emitter element control circuit is a dual in-line package ("DIP") integrated circuit accepting both power and control signals, selectively processing said signals and controlling the output to the connected laser emitters indirectly through pulse width modulation of high power switching devices. Said control circuit is given an 8-bit address through manual DIP switch settings.

In an exemplary application of this embodiment of the present invention, a plurality of array elements is applied to the electrically grounded exterior of a subject aircraft. Said elements are placed to minimize adverse impact on aerodynamics and maximize the ability to radiate likely threats and decoy surfaces. The address switches on said array elements are configured to eliminate duplicate addresses.

The array controller of this exemplary application is electrically connected to the array of elements through the electrically conductive airframe and an additional shared electrically conductive wire through which the array controller provides power and control signals to the array with said power and control signals being separated by the signal/power decombiners located in each array element.

In this application, a single repositionable multi-spectral camera with an evenly spaced homogeneous array of sensor sites is employed as the multi-dimensional sensor used to configure the array. Said camera is attached to the array controller and is utilized to perform automated configuration of the array. Said configuration may also be facilitated by a terminal, computer or other electronic devices that serves as a user interface or otherwise facilitates configuration.

In this application, the array controller is connected to the ECU of the countermeasures suite through a two-way electronic communication link. Through said link, the array controller reports the number of emitter elements, the configuration points of view(s) in which each element provides meaningful irradiance. Using this information, the ECU may then send a signal to the array controller through the electronic communication link calling for the emission of a desired spectrum of EM radiation from elements in the array. The array controller will utilize the previously developed configuration data to generate the appropriate control signal and output it to the array of EM emitter elements over the array's shared electrically conductive medium. The ECU will continue to send requests to alter or cease array output as determined by its programming and the array controller will generate and output the required control signals to the array.

While the exemplary application is on an aircraft, this second embodiment of the present invention could be applied to any vehicle where alteration of the vehicle's EM signature is desired. A second exemplary application of this same embodiment consists of applying the same elements, array controller and configuration camera to an armored vehicle in order to defeat attempts to accurately identify the vehicle with night vision systems and accurately target it with electro-optical and imaging based precision guided munitions.

Embodiment 3—Modified Visible Light Emissions for Low Observable/Low Altitude Reconnaissance Unmanned Aerial Vehicle A third exemplary embodiment of the present invention includes the following devices: visible light emitter elements, a plurality of which is intended to be integrated with the surface of convoluted objects; an array controller capable of converting five video input signals to a control and power signal for an array of EM emitter elements delivered over a single pair of conductors; and an arrangement of 1080p video cameras in a dedicated array configuration facility for providing configuration input to said array controller.

The emitter elements of said embodiment are each composed of a single tri-color high output visible spectrum LED, a control circuit, a protection circuit for limiting potentially damaging electrical signals and a signal/power decombiner circuit for separating the array's electrical power signal from said array's high frequency control signal. Said components are contained in a hexagonal polycarbonate enclosure roughly 5 mm thick and 3 mm in width. Said enclosure contains three dimensional conductive traces for required electrical connections with the only conductive material on the exterior of the enclosure being a 1 mm square conductive plate on the back flat surface and a 1 mm square conductive plate on the front surface of the enclosure. Said exposed conductive material is employed as the electrical connections between each array element and the shared control/power medium of the array.

In this embodiment of the present invention, the emitter element control circuit is a single ultra fine ball grid array ("UFBGA") integrated circuit accepting both power and control signals, selectively processing said signals and controlling the output to connected devices through pulse width modulation. Said control circuit is given a default address through mechanically disabling selective connections between the array power and the UFBGA. Said default address may be superseded through use of a set/change address command delivered through the control signal and stored in non-volatile memory. In this embodiment of the present invention, three of the available control circuit outputs are utilized to control power to the emitter elements through connection to the RGB terminals on the element's high-output tri-color LED.

In one exemplary application of this embodiment of the present invention, said embodiment is applied to an unmanned aerial vehicle (FIG. 7: Embodiment 3—Unmanned Aerial Vehicle Application Overview) with the purpose of decreasing the observability of said vehicle in the visible light spectrum. In this application, the emitter elements (0702) of the present embodiment are located in the cells of the flexible honeycomb core (0701) of the composite skin (0704) of the unmanned aerial vehicle (0707). The upper (0705) and lower (0706) faces of the honeycomb core are each a separate translucent electrical conductor and are electrically bonded to the elements' upper (0703) and lower conductive plates. The remaining components of the subject's skin are non-conductive with the outer layers being translucent.

In this embodiment of the present invention, an array controller is connected to the upper and lower layer of the honeycomb core of each panel of the subject's composite skin. Said array controller provides both power and a high frequency control signal to the array through said connections which are then separated by the signal/power decombiners located in each array element.

In this exemplary application of an embodiment of the present invention, a dedicated facility is employed as the multi-dimensional sensor used to configure the array of emitter elements (0709). The subject vehicle is suspended in a central location in said facility. Said facility employs multiple high resolution video cameras (0708) positioned in locations relative to the subject vehicle that are determined as points of view for which the array should be configured. A display canvas is created for each configuration point of view through the configuration method of FIGS. 5 and 6 and described in earlier embodiments of the present invention. The display canvas creation process is repeated with the control surfaces of the subject aircraft in various positions thus creating canvases to be employed during control activation. Additional canvases are created through interpellation to provide appropriate canvases for use throughout the range of motion of the control surfaces.

In this exemplary application of an embodiment of the present invention, standard video inputs from five video cameras located on the subject provide input signals to the array controller. An electronic control unit separate from the present invention provides a signal to the array controller ranking the priority of the canvases and indicating which portion of each video input should be displayed on each canvas. The array controller then processes and normalizes the video input(s) directed to the highest priority canvas using the collective configuration data developed in the configuration process. The array controller processes and normalizes the video input(s) for the remaining canvases in priority order without disrupting the array elements that are part of higher priority canvases. The resulting aggregated array control signal is output to the array of EM emitter elements.

Other Embodiments and Applications

A single embodiment of the present invention may have a wide range of applications. For example, an embodiment of the present invention is designed to display video images throughout the exterior surface of a pace car at a motorsports event. Said embodiment utilizes the grounded body panels of the vehicle and a conductive translucent paint layer as its two required electrical connections. This same embodiment is applied to the exterior of a tour bus utilizing the same components in greater quantity. The system and method for configuration of the array would adjust for the geometry of the new subject without requiring changes to individual element design, array controller design or connectivity approach.

It is anticipated that embodiments of the present invention will be created that incorporate a wide range of emitters/attenuators, e.g., LEDs, high output lamps, liquid crystals, x-ray emitters, LASERs, etc. It is expected that an embodiment of the present invention may modularize the actual emitter/attenuator portion of the emitter elements allowing the emitter/attenuator to be removed, replaced, remotely located or otherwise reconfigured without impacting other devices or characteristics of the emitter element.

It is expected that the present invention may be used to replace prior art in some applications. For example, in an application of an embodiment of the present invention, an array of addressable electromagnetic emitter elements is utilized to construct an immersive gaming environment. In this application, three walls of a square room are coated with an array of elements as are the ceiling and floor of said room. Said elements emit radiation in the visible light portion of the EM spectrum. Each element at the center region of the walls has two RGB emitters, each with separate dichroic filters polarizing their emissions 90 degrees from each other to support passive stereoscopic 3-D glasses. Said central elements are located with minimal distance from the center of one element to another, i.e., pitch, and oriented with their emissions normal to the plane of the wall. Elements on the ceiling and floors do not possess polarized emitters and are located with greater element pitch, but with the same normal orientation to their respective surfaces. Elements on the periphery of all surfaces are placed with greater element pitch and are oriented so that their emissions are directed toward the center of the room. This application of an embodiment of the present invention provides maximum visual performance in regions of the room likely to be viewed within users' region of greatest stereoscopic acuity and allows less costly elements to be utilized at a lower density on other regions of the room.

As the claims of the present invention do not depend on the size, shape or physical construction of the individual array elements, it is therefore expected that continuing advances in manufacturing, miniaturization, integrated circuit and other relevant technology will enable embodiments of increasingly small size and of varied shapes and physical construction. In an exemplary embodiment of the present invention it is expected that the EM emitter elements of the present invention will be utilized as an additive to surface coatings such as paint.

The medium connecting the array of emitter elements to the array controller(s) is shared by multiple emitter elements. The medium itself may be any material with examples including use of conductive material in the subject, conductive adhesives, conductive coatings, a shared cable, etc. The number of conductors in the medium may vary depending on the application, e.g. large applications may require multiple shared media to support capacity requirements or physically isolated objects.

Array controllers of the present invention are not dependent on source signals of a particular type or following particular standards. As such, array controllers of the present invention are expected to be implemented which accept existing and future standards for the transmission of general electronic and electronic display signals. In addition, embodiments of the array controllers of the present invention are expected to be developed that accept proprietary and specialized signals for individual applications. In one exemplary embodiment of the present invention, a graphical workstation containing three dimensional computer models of complex objects is linked to an array controller for an array of visible light emitter elements on the actual objects. Said embodiment allows the three dimensional computer model's surface emissions such as coloring and graphics to directly control the same characteristics of the array on the real-world objects. Said embodiment eliminates the need to convert the computer model's three dimensional data to a two dimensional representation for display purposes.

Array controllers of the present invention may be constructed in a modular fashion in order to facilitate maintenance, upgrade of capabilities or performance, or change in the number of inputs or outputs.

Array controllers and the perceptual configuration systems of the present invention may be in whole or in part electronically linked to, communicate with, incorporated into or otherwise co-located with a terminal, computer, or other electronic device. An example embodiment of the present invention includes array controller and perceptual configuration system features that are included as part of the feature set of a graphics processor in a computer.

The general configuration methods presented in the exemplary embodiments are expected to vary across embodiments and applications. Representative variations in said methods might include changes in the sequence of steps, excluding one or more steps, incorporating additional steps to meet the needs of a particular embodiment, and performing steps in parallel. As an example, an embodiment of the present invention intended for arrays with a large number of elements might utilize a configuration method that activates multiple elements concurrently and at different output spectra in order to complete the configuration process more rapidly than if all of the elements were activated sequentially.

The present invention is expected to be applied to a wide range of subjects and enable innumerable new and creative applications of electromagnetic emitter technology. The present invention enables arrays of EM emitters to be incorporated throughout the surface of high performance vehicles supporting usages such as on-vehicle display of diagnostic and maintenance information, enhanced low observability throughout the EM spectrum, optimized radio detection and ranging emitter placement, enhance precision directed signaling and communications, dynamic surface color and enabling whole vehicle dynamic graphics and video display. The present invention enables emitters to be incorporated throughout the surface of building interiors supporting usages such as dynamic interior finishes and lighting, creation of immersive virtual reality environments and integration of large scale video displays on practically any combination of surfaces. The present invention is applicable to building exteriors with irregular geometry where information, graphics, videos or advertisements can be displayed without negatively impacting the aesthetics of the structure when the array is inactive. The present invention enables emitters to be incorporated onto a wide range of objects to provide dynamic finishes or on-object video display. Architectural models might display cut away views of interior features, privacy shades display a view of the outside even when closed and complex graphics may be displayed on clothing without adversely affecting the flexibility or wearability of the material. The present invention may be incorporated into industrial facilities and equipment to provide in-process work instructions, material routing information and directions to meeting rooms displayed on building surfaces. The present invention enables application of arrays of electromagnetic emitters to subjects where application of prior art was not practical, provided poor performance or was cost prohibitive.

What is claimed is:

1. A perceptually configured array of addressable electromagnetic emitter elements operative to be attached to or integrated with the surface of an object, comprising:

a plurality of surface-mounted or surface-integrated, individually addressable emitter elements, said elements operative to be placed with varied regularity and orientation on the object;

an array controller operative to compute and store configuration data and further operative to provide power and control signals to said plurality of individually addressable emitter elements over a shared transmission medium; and memory in each individually addressable electromagnetic emitter element operative to store a unique address;

wherein said plurality is operative to provide predictable irradiance forming one or more canvases at one or more points of observation located in three dimensional space around the object, and wherein each emitter element provides no more than one pixel of a canvas.

2. A surface-mounted or surface-integrated, individually addressable emitter element, comprising:

one or more sources operative to selectively emit electromagnetic radiation;

input terminals operative to receive power and control signals from a shared transmission medium;

memory operative to store an emitter element address;

an address comparator circuit operative to compare an address received over the shared transmission medium with the emitter element address; and a controller circuit operative to control the overall emission of electromagnetic radiation from the sources in response to received control signals and an output of the address comparator circuit;

wherein each emitter element is operative to be positioned with varied regularity and orientation when mounted on or incorporated into a surface of an object, and to provide no more than one pixel of a canvas displayed on the surface.

3. The emitter element of claim 2, wherein said controller circuit is further operative to transmit control signals.

4. The emitter element of claim 2, wherein said emitter element is constructed of flexible and malleable materials and is operative to conform to one or more surfaces of the object.

5. The assembly of claim 2 wherein said configuration information controls the emission of electromagnetic radiation from the sources such that a plurality of emitter elements is operative to provide predictable irradiance at one or more points of observation located in three dimensional space around the object.

6. The assembly of claim 5 wherein the configuration information for each emitter element is derived in a configuration procedure in which each emitter element in the plurality is individually enabled and its irradiance evaluated at each point of observation.

7. A method, performed by an array controller, of configuring a system of electromagnetic emitters comprising a plurality of individually addressable electromagnetic emitter elements mounted on or integrated with the surface of an object, the array controller, and a configuration sensor, comprising:

receiving initialization data;

receiving, from the configuration sensor positioned at a first position and orientation in three dimensional space relative to the object, illumination data for each of a plurality of sites observable by the configuration sensor, under ambient light conditions around the object that approximate expected lighting when the system is operative;

in succession for each of the plurality of emitter elements, with the configuration sensor positioned at the first position and orientation, activating a next emitter element to emit electromagnetic radiation at a predetermined level;

receiving, from the configuration sensor, position and irradiance information;

calculating a perceived center of increased illuminance resulting from activation of the current emitter element;

storing the location of the perceived center and irradiance information together with an indication of the current emitter element and configuration sensor position; and deactivating the current emitter element; and storing configuration information for the current position of the configuration sensor.

8. The method of claim 7, wherein the configuration information includes correlations between control signals addressed to a specific emitter element and the apparent location and electromagnetic emission of said emitter element as perceived from the current position of the configuration sensor.

9. The method of claim 7, further comprising repeating the successive emitter element activation, position and irradiance information receiving, calculating, storing, and deactivation steps of the method with the configuration sensor positioned at a second position or orientation in three dimensional space relative to the object, which is different from the first position and orientation; and wherein the configuration information includes one or more of a disparity between address sequence and actual physical emitter element location relative to other emitter elements, variations in the distance between emitter elements (i.e., emitter element pitch), variations in the orientation of each emitter element, variations in the intensity, spectrum, polarization, or field shape of the emissions of each emitter element, variations in reflection and transmission by surrounding materials of each emitter element's emissions and partial or complete obscuring of one or more emitter elements.

10. Test equipment operative in a configuration procedure for a perceptually configured array of addressable electromagnetic emitter elements operative to be attached to or integrated with the surface of an object, comprising:

a signal generator operative to produce and transmit test signals;

one or more multi-dimensional sensors operative to receive electromagnetic radiation from the array of emitter elements at one or more positions and orientations of observation; and an array controller operative to successively activate individual emitter elements in the array to emit electromagnetic radiation at a particular level, and further operative to receive signals from said sensors, calculate emitter element location and configuration information, and store the calculated information.

11. The test equipment of claim 10, further comprising a terminal, computer, or other electronic device communicatively coupled to the array controller.

12. An array controller comprising:

memory operative to store configuration information associated with each of a perceptually configured array of addressable electromagnetic emitter elements attached to or integrated with the surface of an object;

a receiver circuit operative to receive one or more signal (s);

a processor circuit operative to convert the received signals using the configuration information to output signals compatible with the array of emitter elements and operative to cause the array to display one or more canvases, wherein each emitter element provides no more than one pixel of a canvas; and a transmitter circuit operative to transmit electrical power and control signals to the array of emitter elements over a shared transmission medium.

13. The array controller of claim 12, wherein the array controller is communicatively coupled to a terminal, computer, or other electronic device.

* * * * *